US012781292B2

(12) United States Patent
Perizzolo et al.

(10) Patent No.: US 12,781,292 B2
(45) Date of Patent: Nov. 3, 2026

(54) PLANT FOR THE TREATMENT AND RECOVERY OF WHITE SLAG RESULTING FROM STEELMAKING PROCESSES

(71) Applicant: Massimiliano Perizzolo, Zenson di Piave (IT)

(72) Inventors: Massimiliano Perizzolo, Zenson di Piave (IT); Dario Buizza, Ospitaletto (IT)

(73) Assignee: Massimiliano Perizzolo, Zenson di Piave (IT)

( * ) Notice: Subject to any disclaimer, the term of this patent is extended or adjusted under 35 U.S.C. 154(b) by 752 days.

(21) Appl. No.: 17/916,593

(22) PCT Filed: Apr. 1, 2021

(86) PCT No.: PCT/IB2021/052745
§ 371 (c)(1),
(2) Date: Oct. 3, 2022

(87) PCT Pub. No.: WO2021/198977
PCT Pub. Date: Oct. 7, 2021

(65) Prior Publication Data

US 2023/0151446 A1 May 18, 2023

(30) Foreign Application Priority Data

Apr. 3, 2020 (IT) ..... 102020000007093

(51) Int. Cl.
*C21B 3/08* (2006.01)
*C22B 7/04* (2006.01)
(Continued)

(52) U.S. Cl.
CPC ..... *C21B 3/08* (2013.01); *C22B 7/04* (2013.01); *F28D 7/1607* (2013.01); *F28F 5/02* (2013.01);
(Continued)

(58) Field of Classification Search
CPC ..... C21B 2400/024; C21B 2400/052; C21B 2400/054; C21B 2400/056; C21B 3/08;
(Continued)

(56) References Cited

U.S. PATENT DOCUMENTS 1,769,412 A * 7/1930 Bernhard ..... F28F 5/02 165/92
7,854,785 B2 12/2010 Memoli et al.

FOREIGN PATENT DOCUMENTS

CN 1944685 A * 4/2007
EP 2 261 383 A1 12/2010
(Continued)

*Primary Examiner* — Rebecca Janssen
*Assistant Examiner* — Mayela Aldaz
(74) *Attorney, Agent, or Firm* — ASLAN LAW, P.C.

(57) ABSTRACT

A plant for the treatment and recovery of white slag resulting from steelmaking processes. The plant including at least one basic frame; at least one work chamber, movable in rotation around a relevant axis and configured to receive and treat the white slag, the latter being moved forward along at least one direction of treatment. The work chamber including at least one loading portion through which said white slag is loaded; at least one cooling portion arranged downstream of said loading portion and comprising at least one treatment channel of said white slag; and cooling device/structure/component/or the like comprising at least one coolant to cool said white slag to obtain at least one recovery powder; and at least one sorting and separation portion of the recovery powder arranged.

16 Claims, 9 Drawing Sheets

(51) Int. Cl.
*F28D 7/16* (2006.01)
*F28D 21/00* (2006.01)
*F28F 5/02* (2006.01)

(52) U.S. Cl.
CPC .. *C21B 2400/024* (2018.08); *C21B 2400/054* (2018.08); *C21B 2400/056* (2018.08); *F28D 2021/0022* (2013.01)

(58) Field of Classification Search
CPC ... C22B 7/04; F27B 7/38; F27B 7/383; F27D 9/00; F28D 2021/0022; F28D 7/1607; F28F 5/02; Y02P 10/20
See application file for complete search history.

(56) References Cited

FOREIGN PATENT DOCUMENTS

| | | | | | |
|---|---|---|---|---|---|
| EP | 3323898 | A1 * | 5/2018 | ..... | C21B 3/08 |
| IT | VE 20 100 055 | A1 | 4/2012 | | |
| JP | S52-13493 | | 2/1977 | | |
| JP | S52-17388 | | 2/1977 | | |
| WO | WO-2016116884 | A1 * | 7/2016 | ..... | C21B 3/10 |

* cited by examiner

PLANT FOR THE TREATMENT AND RECOVERY OF WHITE SLAG RESULTING FROM STEELMAKING PROCESSES

CROSS-REFERENCE TO RELATED APPLICATIONS

This application claims priority to IT patent application No. 102020000007093 filed on Apr. 3, 2020, and this application claims priority to and is a 371 of international PCT Application No. PCT/IB2021/052745 filed on Apr. 1, 2021, the entire contents of which are hereby incorporated by reference.

TECHNICAL FIELD

The present invention relates to a plant for the treatment and recovery of white slag (also known as ladle slag) resulting from steelmaking processes, produced in the refining stages of liquid steel.

BACKGROUND ART

A further application can also be found in the treatment of AOD (Argon Oxygen Decarburation) slag, which is produced in the decarburization process of stainless steels.

In addition, the proposed plant can also be conveniently adopted for cooling and sorting in an optimal manner any powder or granular material.

The white slag is mainly composed of the lime required for the refining processes, of the reaction products of the de-oxidation and desulphurization stages of the liquid steel bath and of the wear materials of the ladle refractory.

The lime still present at the end of the refining process can be enhanced, e.g., by its use in a new steelmaking process, or for other uses.

The regulations in force define white slag as special waste that must therefore necessarily be disposed of, with consequent increases in the production costs and considerable consequences on the environment.

In order to overcome these drawbacks, over the years there has been a considerable increase in proposals for the recovery of white slag, with the aim of achieving advantages both from a productive point of view, optimizing and economizing the process, and from an environmental point of view thanks to the reduction of disposal in landfills and the exploitation of quarries to obtain limestone for the preparation of lime. And here, without deliberately referring to the great saving obtained in terms of reduction in carbon dioxide emissions produced by limestone firing. The recovery of white slag is generally carried out through a process known as "withering", wherein, as a result of controlled cooling, di-calcium silicate, one of the main components of white slag, undergoes an increase in volume with consequent fragmentation and pulverization of the entire matrix that makes up the white slag.

Several types of plants for the treatment and recovery of the white slag are known, nevertheless they either feature a series of problems or they have not been followed up with a suitable and performing plant application and have been abandoned after their first pilot or industrial test.

A first type of plant is the "static" type, i.e. in which the recovery of white slag is carried out by letting it cool down in a chamber of one or more boxes, until it is pulverized. This solution has poor efficiency of thermal exchange, hence the need for very long times to achieve the fragmentation of the material.

A plant of the static type is described by U.S. Pat. No. 7,854,785.

These "static" type systems, characterized by slow kinetics that require important plant structures, have been surpassed by rotary type reactors, cooled externally with water and/or internally with air and, therefore, in direct contact with the slag.

These solutions have the advantage of implementing a continuous mixing of the material inside the drum, thus carrying out the continuous renewal of the slag in contact with the cooling wall.

Among these, various types are known that differ from each other, as well as also for the use of air inside the reactor to support the external water, for the different way of carrying out the process (continuous or batch), for the different type of cooling of the water supply (on the external surface, inside liners or free), as well as for the different morphology of the drum construction.

Some plants of the rotary type are described by JP S52-13493 and JP S52-17388, EP 2 261 383 A1, EP 3 247 811 A1 and EP 3 323 898 A1.

Among these, documents JP S52-13493 and JP S52-17388 describe a method of withering the material, with its indirect cooling through the outer surface of an open tubular reactor in which the white slag is placed. Some water is sprayed on the upper surface of the reactor, which is then collected in a tank located below the reactor itself. The limitations of the proposal are obvious, with only the upper surface to operate the heat exchange, in addition to the considerable dispersion of water and the ease for the liquid, coming into contact with the slag, to degrade it.

Document EP 2 261 383 A1 describes a method for the recovery of white slag in an open tubular reactor, wherein cooling is mainly carried out by a stream of air affecting the inner region of the drum, as well as by a series of nozzles positioned under the rotating drum and capable of spraying water against the outer surface. The method, with batch operation, also has the limitation of a reduced exchange surface and the use of air in direct contact with the slag, with the obvious negative consequences it entails. Documents EP 3 247 811 A1 and EP 3 323 898 A1 relate to plants for the treatment and recovery of white slag, through the system of indirect heat exchange with a "closed circuit" coolant.

Both of these plants have a rotating chamber in which controlled cooling of the white slag takes place, so as to allow the so-called withering to occur, followed by subsequent screening of the powder obtained through this process.

Other plants for the cooling of white slag are known from U.S. Pat. No. 1,769,412 A, CN 1 944 685 A, and IT VE 20 100 055 A1.

Document U.S. Pat. No. 1,769,412 A describes a cooling device, in particular for calcined ores, having a work chamber movable around a relevant axis and inside which are housed a plurality of treatment channels intended to receive the material to be treated. During the rotation of the work chamber, each treatment channel is subjected to cooling through two separate modes. In fact, in the lower part, the treatment channels pass through a tank filled with water under static conditions, while subsequently, when they rise upwards and reach the top in their circular movement, they are subjected to further cooling by means of water spray. The cooling water therefore only skims the work chamber from the outside. As a result, the heat exchange processes are characterized by low efficiency.

Moreover, there are considerable losses of water due to evaporation processes, with the system requiring significant availability of "disposable" water, in addition to making the work environment decidedly impractical, for the vapors and mists occurring.

Another device to cool the slag down is known from CN 1 944 685 A, which discloses a rotary reactor characterized by an outer annular section in which water flows so as to keep the outer surface "cold", and by an inner coaxial cylinder. The latter in turn contains a certain number of drums, submerged in water. The material to be cooled down is inserted both in each of the drums and inside an interspace defined between the outer circular crown and the inner cylinder. The cooling water is sent countercurrent to the direction of forward movement of the material to be cooled and, in particular, it is introduced at the point where the outlet area of the cooled material is located and it exits at the point where the loading area of the material to be cooled is located. Before the main pipe of the cooling water inlet enters the reactor, a branch of the pipe is separated to feed the outer circular crown. At the inlet of the slag, an air insufflation system is also installed which is adapted to promote the material to cool down.

The document IT VE 20 100 055 A1 discloses, on the other hand, the withering process in an open tubular reactor, with free water that is dosed through the aid of sprays on the upper external surface of the reactor shell, and then collected in a tank located below the same machine. Also this solution has some drawbacks, such as the deterioration of the slag, the reduced heat exchange surface, the loss of cooling liquid, the lack of cooling of the hot slag loading area, the difficulty in managing the process parameters.

The heat exchange between the slag layer and the reactor wall, being managed by basically conductive type processes, is characterized by low values of the exchange coefficient. This implies the need to have large surfaces and, therefore, reactors characterized by important dimensions to be able to ensure the appropriate capacity. A relevant aspect concerns the plant dimensions, which are often a big issue due to the limited space available in the factories.

Again, the standardization of the machines is complex, with consequent increase in both engineering and construction costs.

DESCRIPTION OF THE INVENTION

The main aim of the present invention is to devise a plant for the treatment and recovery of white slag resulting from steelmaking processes which allows optimizing the cooling process of the white slag in a confined environment.

Another object of the present invention is to devise a plant for the treatment and recovery of white slag resulting from steelmaking processes which allows the efficient and easy treatment of even large quantities of white slag, in small reactors.

A further object of the present invention is to obtain large exchange surfaces, without limiting the possibility of feeding pasty material and/or with the presence of coarse sized solid blocks.

Another object of the present invention is to devise a plant for the treatment and recovery of white slag resulting from steelmaking processes which is small in size and which allows adapting to the factory in which it is installed and to the production requirements of the same by making, in the same reactor and continuously, the phases of cooling and recovery through the selection of the withered material.

A further object of the present invention is to devise a plant for the treatment and recovery of white slag resulting from steelmaking processes which allows facing different plant capacity, thus reducing engineering, construction and maintenance costs.

Another object of the present invention is to devise a plant for the treatment and recovery of white slag resulting from steelmaking processes which allows overcoming the aforementioned drawbacks of the prior art within a simple, rational, easy, effective to use and low cost solution.

The objects set out above are achieved by the present plant for the treatment and recovery of white slag resulting from steelmaking processes having the characteristics of claim 1.

BRIEF DESCRIPTION OF THE DRAWINGS

Other characteristics and advantages of the present invention will become more evident from the description of a preferred, but not exclusive, embodiment of a plant for the treatment and recovery of white slag resulting from steelmaking processes, illustrated by way of an indicative, yet non-limiting example, in the accompanying tables of drawings wherein.

EMBODIMENTS OF THE INVENTION

Figure 1:
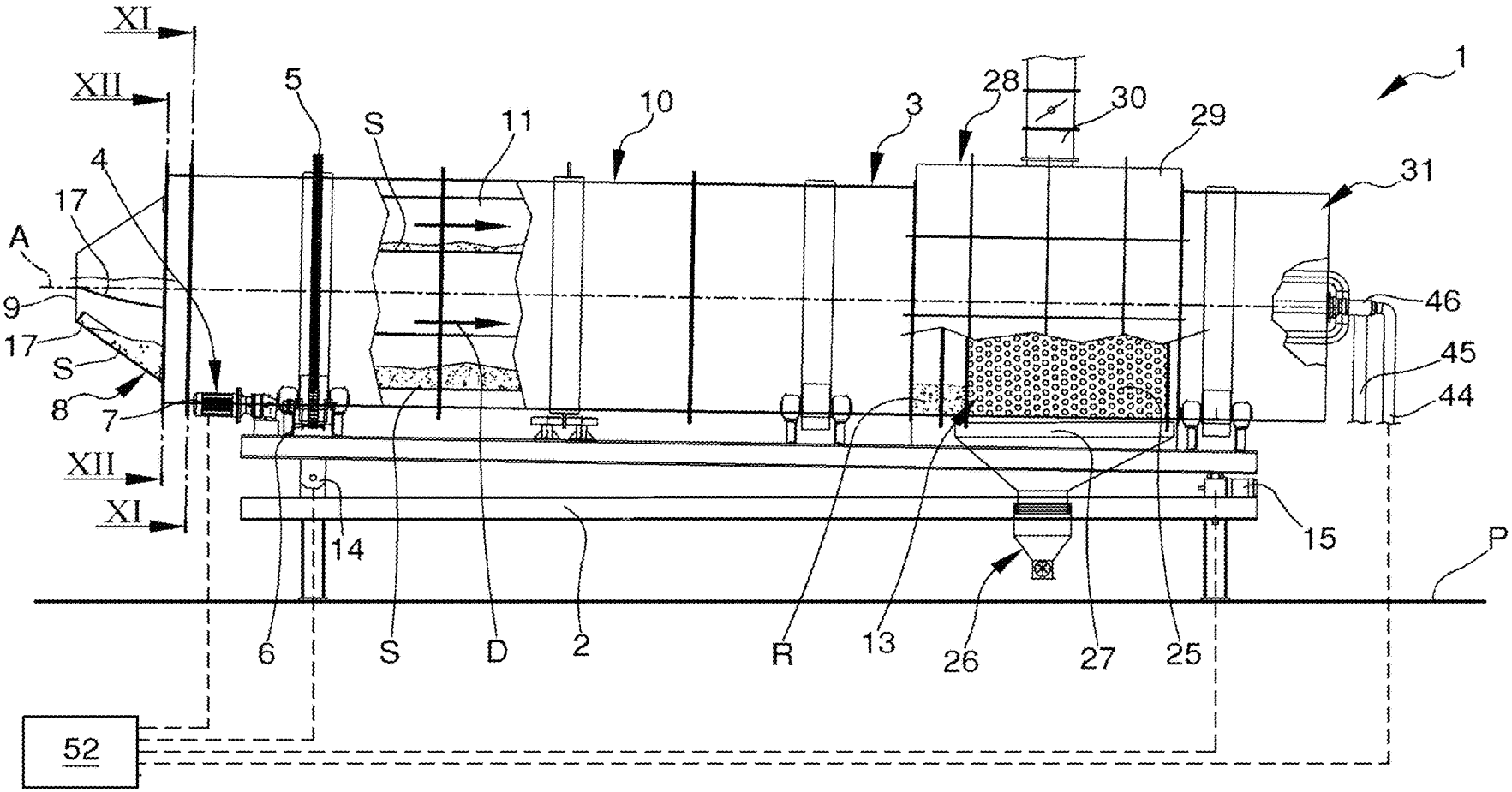
FIG. 1 is a side, partly broken view, of a plant for the treatment and recovery of white slag according to the invention, in a first embodiment.
Figure 2:
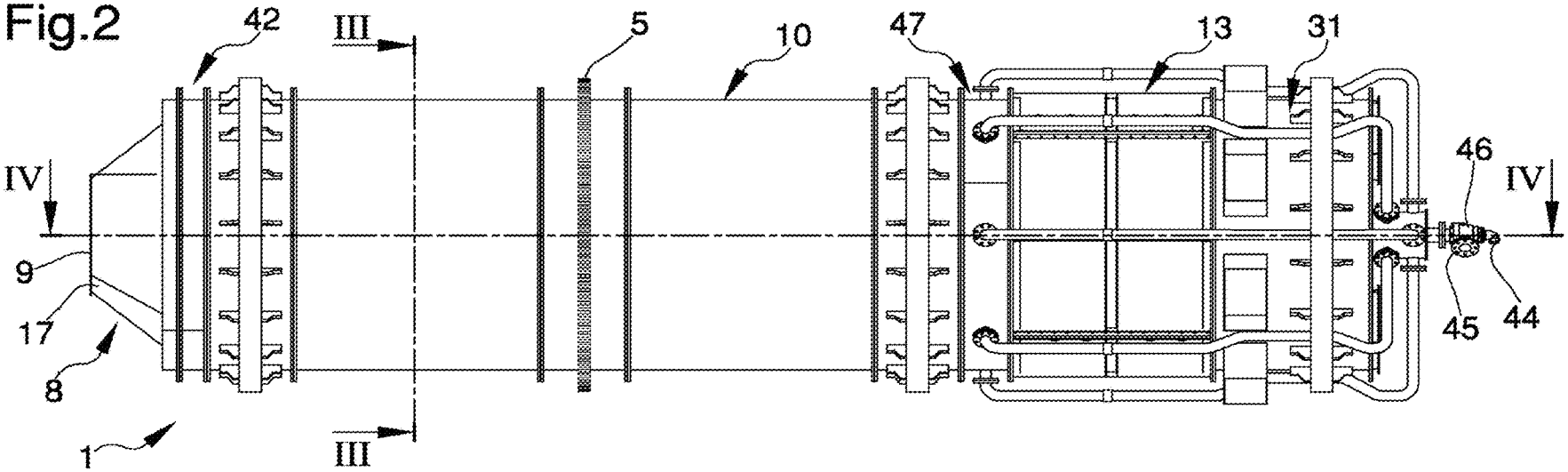
FIG. 2 is a first plan view from above of a plant according to the invention, in a second embodiment.
Figure 3:
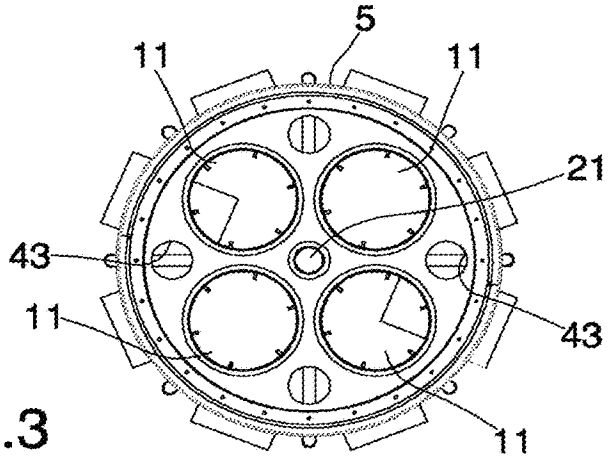
FIG. 3 is a cross-sectional view along the III-III track plane of FIG. 2.
Figure 4:
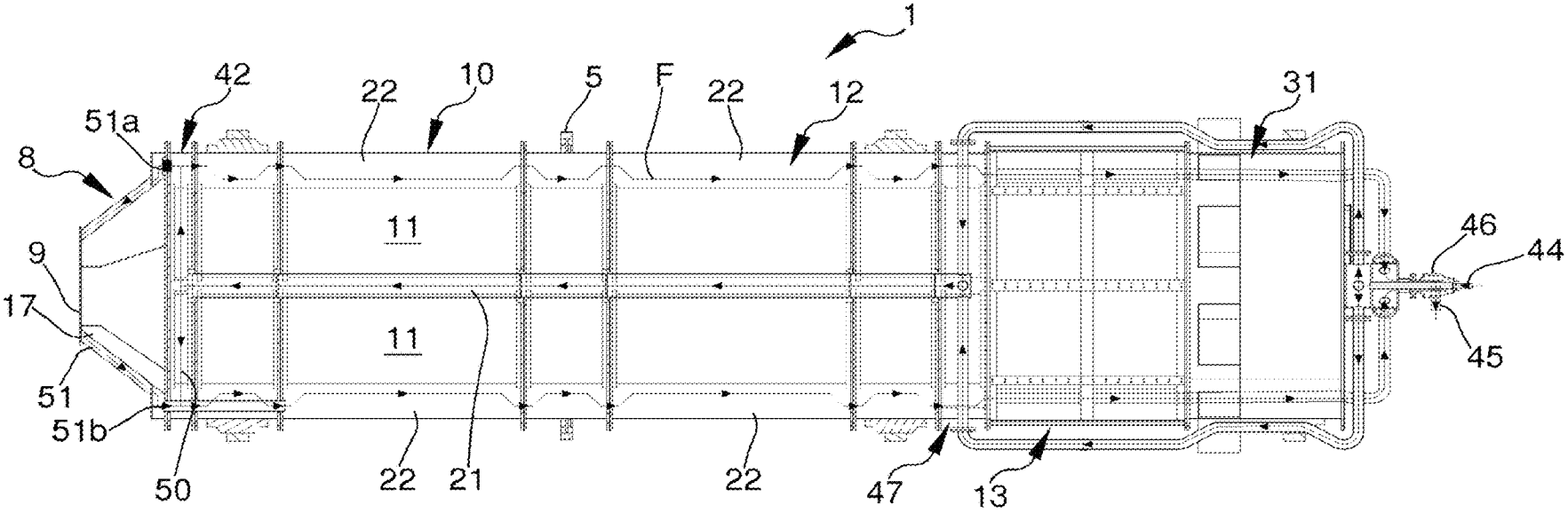
FIG. 4 is a cross-sectional view along the IV-IV track plane of FIG. 2, in which the path of the coolant is shown.
Figure 5:
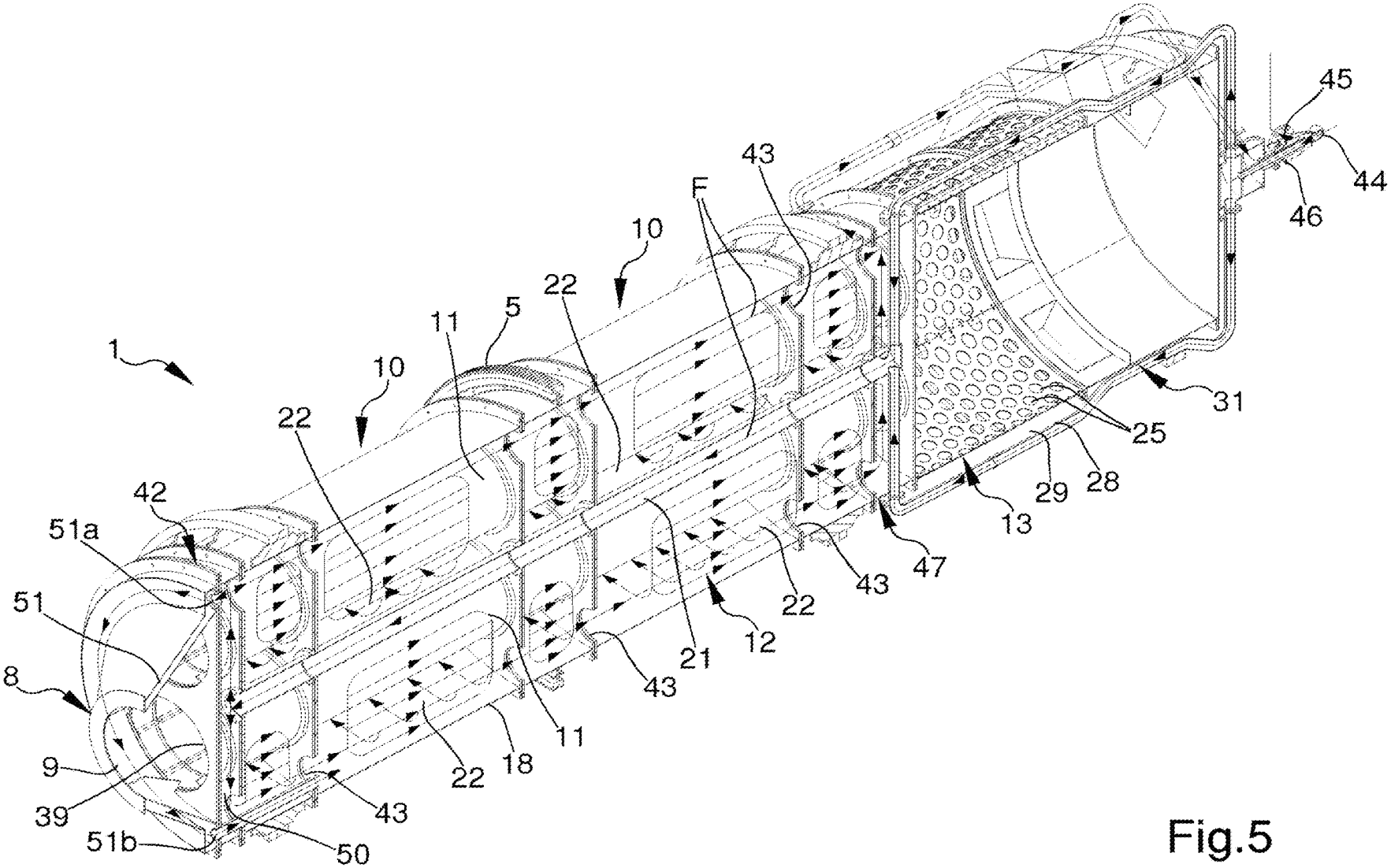
FIG. 5 is an axonometric view of the section in FIG. 4, in which the involved streams are identified.
Figure 6:
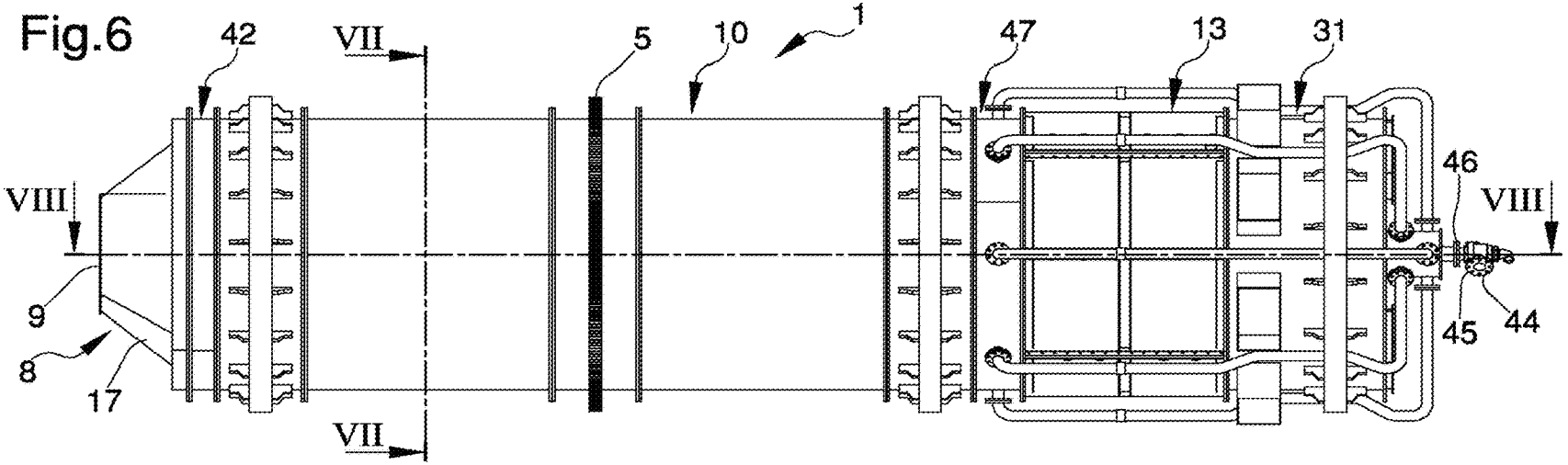
FIG. 6 is a second plan view from above of the plant in FIG. 2, rotated by 45° with respect to the view in FIG. 2.
Figure 7:
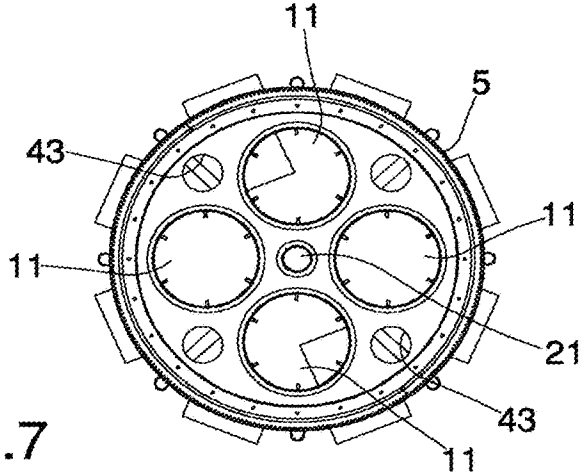
FIG. 7 is a cross-sectional view along the VII-VII track plane of FIG. 6.
Figure 8:
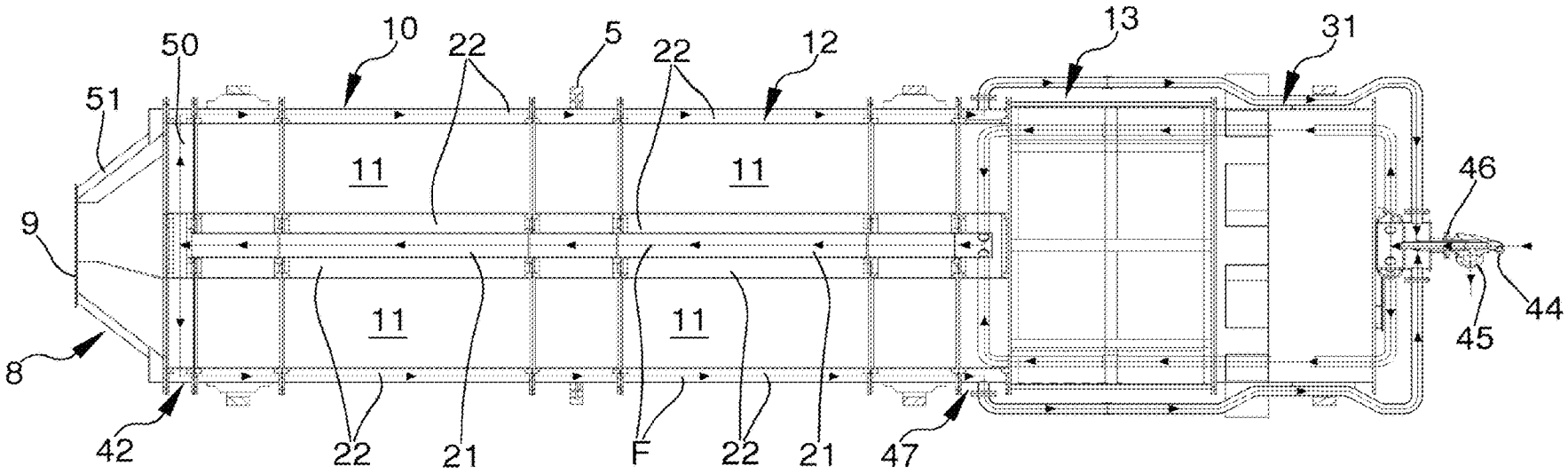
FIG. 8 is a cross-sectional view along the VIII-VIII track plane of FIG. 6.
Figure 9:
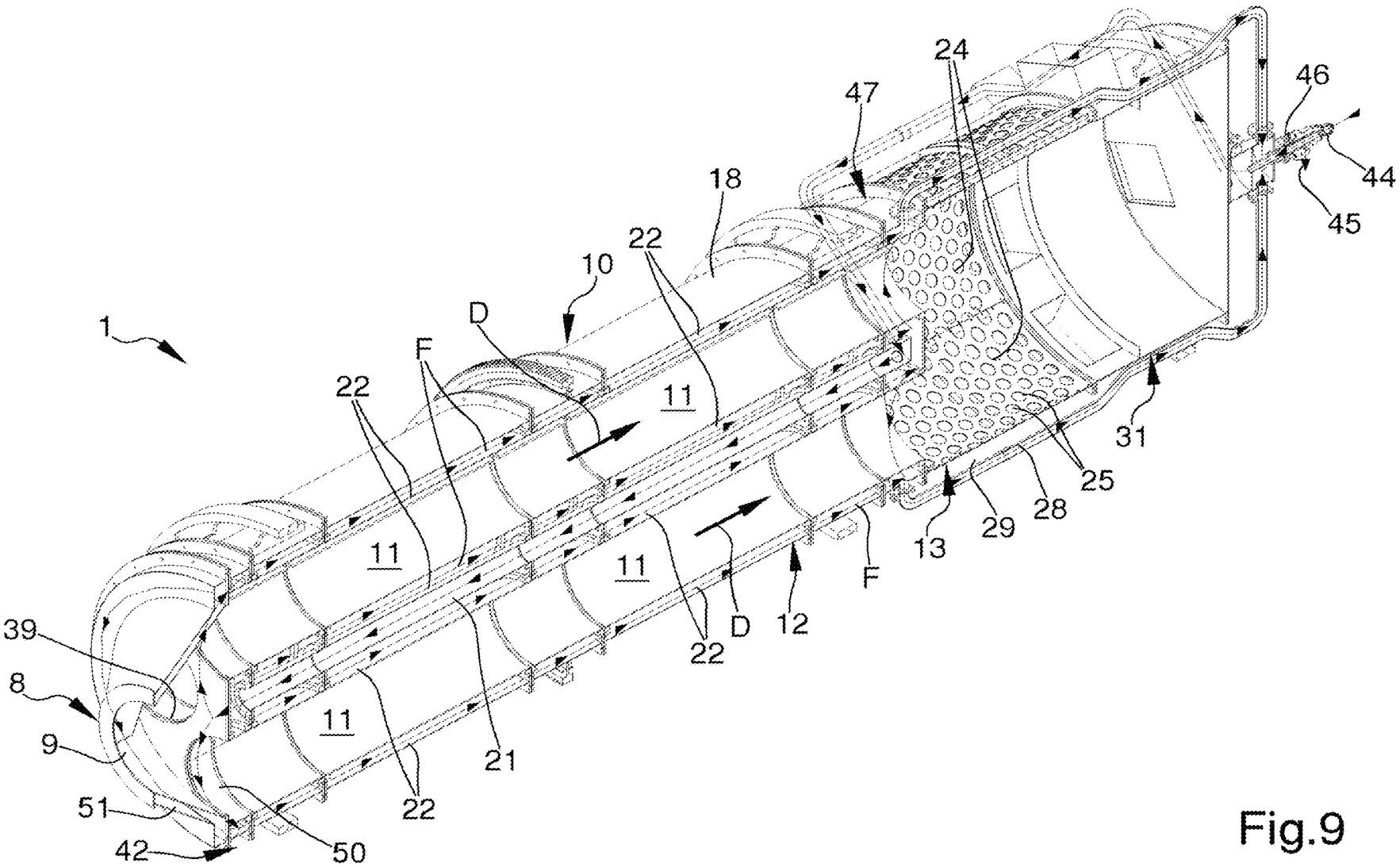
FIG. 9 is an axonometric view of the section in FIG. 8, in which the path of the coolant is identified.

With particular reference to these figures, reference numeral 1 globally indicates a plant for the treatment and recovery of white slag resulting from steelmaking processes.

In the context of the present disclosure, the term "white slag" relates to a by-product of the steelmaking processes for the production of liquid steel.

The plant 1 comprises at least one basic frame 2 positionable resting on a supporting surface P.

In particular, the supporting surface P is substantially horizontal and, preferably, coincides with the ground.

The plant 1 comprises at least one work chamber 3 associated with the basic frame 2, movable in rotation around a relevant axis A and configured to receive and treat the white slag S resulting from steelmaking processes by means of a withering process.

In the context of the present disclosure, by the term "withering process" is meant the controlled cooling of the white slag, preferably in a confined atmosphere to avoid the chemical degradation thereof, which leads to a change in the volume of the crystal lattice of one of its main components, di-calcium silicate, with consequent fragmentation and pulverization of the material. The resulting lime-rich powder is enhanced by its use in a new steelmaking process (recycling of the material inside the same production cycle) or for other applications.

The work chamber 3 has an elongated conformation and the axis A substantially coincides with the longitudinal axis of the work chamber itself.

The plant 1 further comprises movement means 4 of the work chamber 3 adapted to set the work chamber itself in rotation.

In the embodiment shown in the figures, the movement means 4 comprise:

- at least one crown gear 5 associated externally with the work chamber 3 and arranged to surround the latter;
- at least one pinion 6 that meshes with the crown gear 5;
- at least one motor 7, variable speed, associated with the basic frame 2 and adapted to operate the pinion 6.

It cannot, however, be ruled out that the movement means 4 are of a different type and that the rotation of the work chamber 3 is carried out in another way.

During the withering process, the white slag S is moved forward along at least one direction of treatment D.

In particular, the rotation of the work chamber 3 determines the forward movement of the white slag S.

The direction of treatment D is substantially parallel to the axis A.

The work chamber 3 comprises:

- at least one loading portion 8 provided with at least one inlet port 9 through which the white slag S is loaded;
- at least one cooling portion 10 arranged downstream of the loading portion 8 with respect to the direction of treatment D and comprising:
- at least one treatment channel 11 of the white slag S; and
- cooling means 12 comprising at least one coolant F adapted to operate in conjunction with the treatment channel 11 to cool the white slag S contained therein so as to obtain at least one recovery powder R;
- at least one sorting and separation portion 13 of the recovery powder R arranged downstream of the cooling portion 10 with respect to the direction of treatment D.

In detail, as a result of its loading inside the work chamber 3, the white slag S is moved along the direction of treatment D in succession through the aforementioned portions 8,10, 13.

Advantageously, the work chamber 3 is inclined with respect to the horizon, with the loading portion 8 positioned at a higher level than the sorting and separation portion 13.

In other words, the sorting and separation portion 13 is closer to the supporting surface P with respect to the loading portion 8.

Thus, as a result of the loading of the white slag S inside the loading portion 8, a stream of white slag S is generated by gravity and directed towards the sorting and separation portion 13, i.e. downwards.

The plant 1 is also provided with inclination adjustment means 14,15 for adjusting the inclination which are associated with the basic frame 2.

The adjustment means 14,15 are adapted to allow simple and easy variation of the inclination of the work chamber 3.

It is easy to understand that greater inclination of the work chamber 3, with the rotational speed being equal, leads to an increase in the transit speed of the white slag S inside the work chamber itself.

The adjustment means 14,15 thus allow adjusting the residence time of the white slag S to be treated in the plant to the final temperature of the white slag S at the outlet.

The adjustment means 14,15 comprise a hinging member 14 arranged in the proximity of one of either the loading portion 8 or the sorting and separation portion 13 and a movement device 15, of the type of, e.g., a jack arranged in the proximity of the other of either the loading portion 8 or the sorting and separation portion 13.

Advantageously, the plant 1 comprises at least one control and command unit 52 operatively connected to at least one of either the movement means 4 or the adjustment means 14,15 and configured to control the operation thereof.

Conveniently, the control and command unit 52 is operatively connected also to the slag feeding system, so as to reduce or increase the flow rate of the slag introduced into the plant 1 according to the loading or unloading temperatures to be managed.

Appropriately, sensor means, not visible in detail in the figures, are provided, adapted to detect the temperature of the recovery powder R and operatively connected to the control and command unit 52, which is configured to adjust at least one of either the movement means 4 or the adjustment means 14,15 according to the temperature detected by the sensor means. The sensor means are positioned, e.g., at the point where the sorting and separation portion 13 is located.

More particularly, the control and command unit 52 is configured to increase the rotational speed of the work chamber 3 by operating on the movement means 4 and/or to vary the inclination of the work chamber itself by operating on the adjustment means 14,15 when the temperature detected by the sensor means exceeds a preset reference value.

The loading portion 8 has a substantially truncated-cone shape, diverging away from the inlet port 9.

Such a shape facilitates the outflow of the white slag S towards next cooling portion 10. According to the invention, the cooling portion 10 comprises a plurality of treatment channels 11 which are separate from each other and communicating with the loading portion 8, each of which is adapted to receive a part of the white slag S as a result of the rotation of the work chamber 3, to cool and convey it towards the sorting and separation portion 13.

As can be seen from the figures, such an embodiment allows splitting the white slag S to be treated into a plurality of streams, separate from each other, thus increasing the exchange surface between the white slag S and the cooling means 12, thus optimizing the withering process and reducing the size of the plant 1. Still according to the invention, the cooling means 12 are arranged to at least partly enfold the treatment channels 11 and comprise at least one delivery channel 21, which extends at least through the cooling portion 10 to send the coolant F towards the loading portion 8 counter-currently with respect to the direction of treatment D, and at least one return channel 22, which extends at least through the cooling portion 10 and is arranged to surround the delivery channel 21 to send the coolant F towards the sorting and separation portion 13 in a parallel manner, i.e., equi-currently, to the direction of treatment D.

One stretch of the return channel 22 is therefore positioned between the delivery channel 21 and the treatment channels 11. The return channel 22 therefore surrounds the treatment channels 11.

The cooling means 12 comprise, then, at least one inlet manifold 42 arranged at the point where the loading portion 8 is located and adapted to transfer the coolant F from the delivery channel 21 to the return channel 22.

More particularly, the inlet manifold 42 is positioned between the loading portion 8 and the cooling portion 10.

The delivery channel 21 and the return channel 22 are contained inside the work chamber 3.

The cooling means 12 and the treatment channels 11 rotate integrally with each other around the axis A.

More particularly, the inlet manifold 42 defines at least one transfer chamber 50 of the coolant F communicating with the delivery channel 21 and with the return channel 22 and through which the treatment channels 11 pass.

Advantageously, the loading portion 8 is arranged opposite the cooling portion 10 with respect to the inlet manifold 42 and defines at least one interspace 51 communicating with the transfer chamber 50.

More in detail, the interspace 51 comprises at least one inlet gap 51*a* of the coolant F communicating with the transfer chamber 50 and at least one outlet gap 51*b* of the coolant F communicating with the return channel 22. The interspace 51 is therefore adapted to receive the coolant F coming from the delivery channel 21, so as to cool the slag S that is introduced therein, and then conveys the coolant itself inside the return channel 22.

Preferably, the cooling means 12 comprise at least one internally hollow cooling liner 18; the delivery channel 21 and the return channel 22 are arranged inside the cooling liner 18.

In particular, the return channel 22 is positioned between the cooling liner 18 and the delivery channel 21 and the treatment channels 11 are inserted inside the return channel 22.

Conveniently, the cooling means 12 also comprise an outlet manifold 47, communicating with the return channel 22, which is adapted to collect the coolant F passing through the return channel itself and to convey it outwards.

The delivery channel 21 passes through the outlet manifold 47, exiting outside the work chamber 3.

The outlet manifold 47 is positioned between the cooling portion 10 and the sorting and separation portion 13.

In the embodiment shown in FIGS. 2 to 9, both the delivery channel 21 and the return channel 22 exit outside the work chamber 3 by means of the relevant piping at the point where the outlet manifold 47 is located.

Advantageously, the plant 1 comprises supply means 44 of the coolant F communicating with the delivery channel 21 and discharge means 45 of the coolant F communicating with the return channel 22, where the supply means 44 and the discharge means 45 are arranged outside the work chamber 3.

More particularly, the supply means 44 comprise at least one fixed supply duct and the discharge means 45 comprise at least one fixed discharge duct, which are arranged downstream of the sorting and separation portion 13 and are connected, respectively, to the delivery channel 21 and to the return channel 22 by means of a rotary joint 46. Preferably, the control and command unit 52 is operatively connected also to the supply means 44 and is configured to operate thereon, so as to vary the flow rate of the coolant F, depending on the temperature detected by the sensor means.

In particular, the control and command unit 52 is configured to increase the flow rate of the coolant F when the temperature of the recovery powder R detected by the sensor means exceeds a preset reference value.

Conveniently, the treatment channels 11 are substantially parallel to each other.

The dimensions of the treatment channels 11 are such that even coarse pieces can pass through.

Furthermore, the treatment channels 11 are arranged in a radial pattern with respect to the axis A and each of them comprises a supply port 16 communicating with the loading portion 8.

In the embodiment shown in the figures, the treatment channels 11 have a substantially cylindrical shape.

It cannot however be ruled out that the treatment channels 11 may have a shape of different geometry.

The white slag S is distributed into the treatment channels 11 by gravity, as a result of the rotation of the work chamber 3.

In detail, the rotation of the work chamber 3 causes each supply port 16, in turn, to be at the point where an accumulation is located of the white slag S being loaded into the loading portion 8, allowing it to be automatically split.

In this regard, the loading portion 8 is conveniently provided with a plurality of conveying elements 17 adapted to direct the white slag S towards the treatment channels 11.

The conveying elements 17, of the type of, e.g., helical fins, are internally associated with the loading portion 8 and extend between the inlet port 9 and the supply ports 16.

Inside each of the treatment channels 11, the white slag S is subjected to a continuous and controlled cooling process that causes the fragmentation thereof so as to obtain the recovery powder R.

Cooling is carried out indirectly through the walls of the treatment channels 11, by means of the coolant F flowing inside the return channel 22 located around the treatment channels 11.

In this regard, the plant 1 allows dividing the white slag S into several separate streams and cooling them down, by means of a considerably increased exchange surface, with the external dimensions being equal, so that even large quantities of white slag S can be treated, thus ensuring at the same time effective cooling, while keeping the dimensions of the plant 1 considerably reduced.

As a result of the rotation of the work chamber 3, the white slag S continuously contacts, by moving forward and mixing, the areas of the treatment channel 11 which are cooled by the coolant F.

The rotation of the work chamber 3, in fact, causes the white slag S to rotate in turn and always be in contact with a continuously cooled area of the treatment channel 11.

In addition, the rotational speed of the work chamber 3 defines the transit speed of the white slag S inside both the cooling portion 10 and the sorting portion 13, thereby establishing the plant flow rate.

Conveniently, each of the treatment channels 11 comprises a plurality of mixing elements 23 which extend along the direction of treatment D, and which are adapted to mix the white slag S and to convey it towards the sorting and separation portion 13.

The mixing elements 23, configured e.g. as fin segments, are preferably arranged axially on the inner wall of each treatment channel 11.

Alternatively or in combination thereof, the mixing elements 23 may extend in a continuous or semi-continuous spiral pattern on the inner wall of each treatment channel 11 along the respective direction of treatment D.

The mixing elements 23, as a result of the rotation of the work chamber 3 around the axis A, cause the white slag S to be lifted and mixed, thereby promoting the cooling thereof.

In addition, the mixing elements 23 contribute to the forward movement of the stream of white slag S along the direction of treatment D.

Even if the environment is always confined, in an embodiment of the present invention, the plant 1 may also comprise inertization means, not shown in detail in the figures, associated with the work chamber 3 and adapted to generate a controlled atmosphere inside at least the cooling portion 10.

In this way, the withering process takes place in an atmosphere with a reduced content of humidity and carbon dioxide, in order to avoid possible processes of hydration, carbonation and, therefore, the degradation of the withered white slag S.

Each of the treatment channels 11 comprises an outlet port 24, opposite the inlet port 9 and communicating with the sorting and separation portion 13.

In particular, the sorting and separation portion 13 is adjacent and integral with the cooling portion 10.

The recovery powder R that is generated by the withering process of the white slag S exits the treatment channels 11 through the respective outlet ports 24 and flows out, by discharging it into the sorting and separation portion 13.

Conveniently, the sorting and separation portion 13 comprises a plurality of holes 25, each provided with at least a predefined size, adapted to allow the outflow of the recovery powder R.

Conveniently, it could be provided inside with a series of longitudinal fins, not shown here, which are adapted to lift the powder to avoid any packing and facilitate the sorting thereof.

The holes 25, adequately calibrated, allow screening the recovery powder R enabling only the recovery powder R to flow out which has undergone a correct withering process.

The plant 1 also comprises collection means 26 of the recovery powder R arranged below the sorting and separation portion 13. The recovery powder R falls by gravity from the sorting and separation portion 13 to the collection means 26.

The collection means 26 comprise at least one collection member 27, of the type, e.g., of a hopper, adapted to convey the recovery powder towards other recovery stations.

Advantageously, below this collection hopper for the recovery powder there is a damper, not visible in detail in the figures, which can be operated manually to allow the powder to be discharged.

The plant 1 is further provided with a powder containment system 28 associated with the work chamber 3 and arranged to surround at least the sorting and separation portion 13.

In particular, the containment system 28 comprises a powder containment chamber 29 adapted to house the sorting and separation portion 13 and part of the collection member 27.

The function of the powder containment chamber 29 is to prevent the recovery powder R from being dispersed into the external environment, and it is provided with rotary seals on the outside.

For this purpose, the containment system 28 also comprises a suction device 30 associated with the powder containment chamber 29.

The products that maintain a greater size than the predefined size at the end of the withering process form a waste product of the treatment process, basically consisting of a metal-slag mixture.

Conveniently, the work chamber 3 comprises at least one unloading portion 31 arranged downstream of the sorting and separation portion 13 with respect to the direction of treatment D and adapted to allow the unloading of the waste product resulting from the withering process.

Preferably, below this unloading portion 31 there is a damper, not shown in detail in the figures, which is manually operable to allow unloading the waste product.

Through the unloading portion 31, the waste product exits the work chamber 3 and is conveyed to further disposal or recovery stations.

Advantageously, the plant 1 comprises a plurality of modular elements 32 that can be assembled together to define at least said cooling portion 10.

This embodiment makes it possible to modify and adapt the plant 1 on the basis of the amount of white slag S to be treated in a simple and easy manner, simply by implementing or reducing the number of modular elements.

Figure 10:
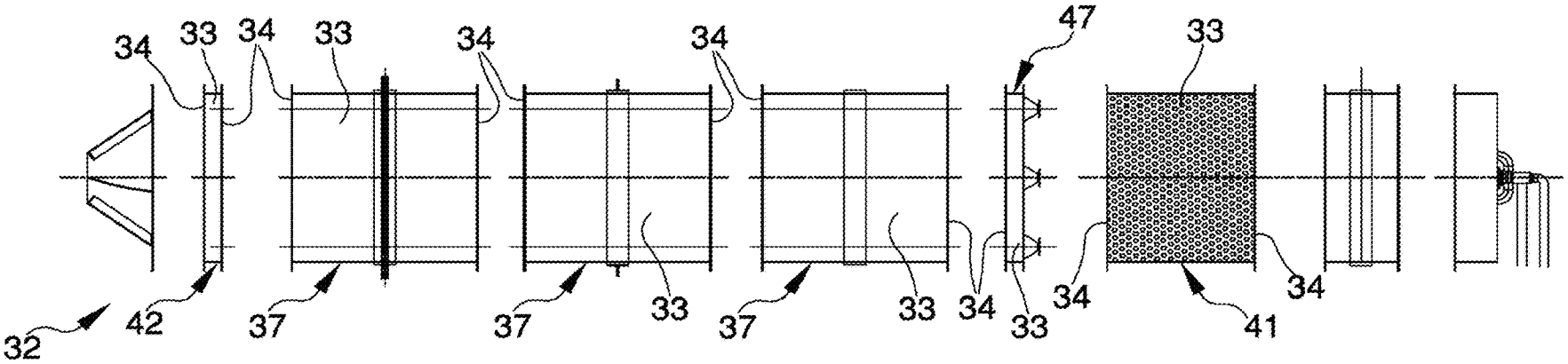
FIG. 10 is an exploded view of a component of the plant in FIG. 1.

As shown in FIG. 10, each modular element 32 comprises at least one central member 33 that partly defines the work chamber 3 and a pair of lateral faces 34 opposite each other, each adapted to contact a lateral face 34 of an adjacent modular element 32.

In more detail, the central member 33 has a substantially cylindrical shape and extends along the axis A, while the lateral faces 34 have a substantially circular shape and are substantially perpendicular to the axis A.

Conveniently, the plant 1 comprises connecting means 35 of the modular elements 32 adapted to connect and keep the modular elements themselves joined together.

The connecting means 35 are, e.g., perforated flanges associated with the outer wall of each modular element 32.

In more detail, the connecting means 35 are associated with the lateral faces 34 of the modular element 32.

The plant 1 also comprises sealing means 36, of the type e.g. of circular gaskets, positioned between the modular elements 32 and adapted to operate in conjunction with the connecting means 35 to hermetically connect the modular elements 32.

The modular elements 32 comprise at least cooling modules 37 that can be assembled together to define the cooling portion 10.

The cooling modules 37 are, therefore, adapted to define the treatment channels 11 and the cooling liner 18.

Each cooling module 37 also defines a relevant portion of the delivery channel 21 and of the return channel 22 adapted to contain the coolant F.

Figure 11:
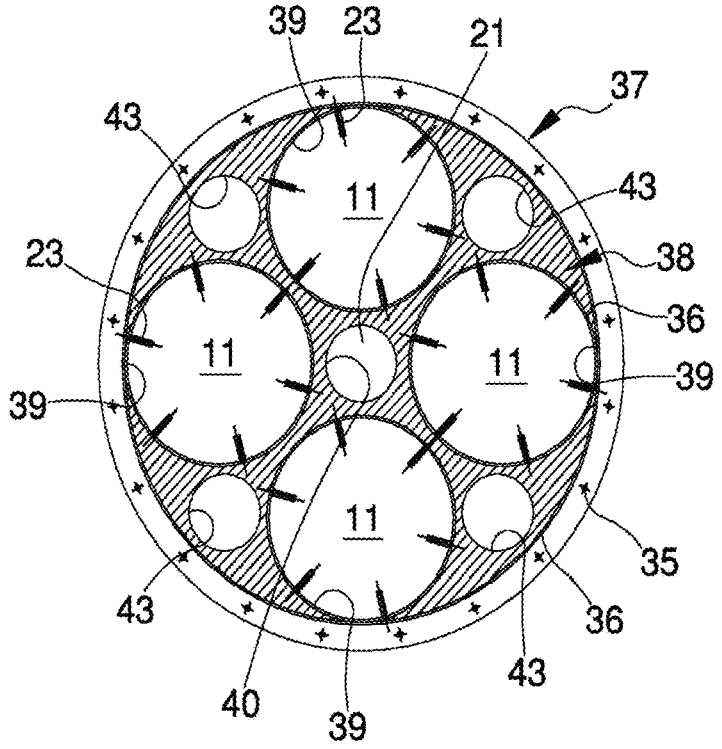
FIGS. 11 and 12 are cross-sectional views along the XI-XI and XII-XII track planes of FIG. 1, respectively.

As shown in FIG. 11, each of the lateral faces 34 of the cooling modules 37 comprises a closing plate 38 provided with:

- a plurality of first openings 39 for the passage of the white slag S, corresponding to the number of the treatment channels 11;
- at least a second opening 40 communicating with the delivery channel 21 for the passage of the coolant F; and
- a plurality of third openings 43 communicating with the return channel 22 for the passage of the coolant F.

The cooling modules 37 are, therefore, assembled in succession with each other to form the cooling portion 10 based on the required plant capacity.

It is easy to appreciate that as the size of the cooling portion 10 increases, the sorting and separating portion 13 must also be suitably sized in order to allow for an effective screening of the recovery powder R.

To this end, the modular elements 32 also comprise sorting modules 41 that can be assembled together to define the sorting and separation portion 13.

The central member 33 of the sorting modules 41 is provided with the holes 25 and the lateral faces 34 are open to allow the passage of the recovery powder R and of the waste product.

The collection means 26 and the containment system 28 are conveniently made to match the size of the sorting and separation portion 13.

Conveniently, the modular elements 32 also comprise the inlet manifold 42, which connects the loading portion 8 to a subsequent cooling module 37, and the outlet manifold 47, which connects the last of the cooling modules 37 to the first sorting module 41.

Substantially, the inlet manifold 42 and the outlet manifold 47 define the cooling portion 10, by limiting it, with the cooling modules 37.

Figure 12:
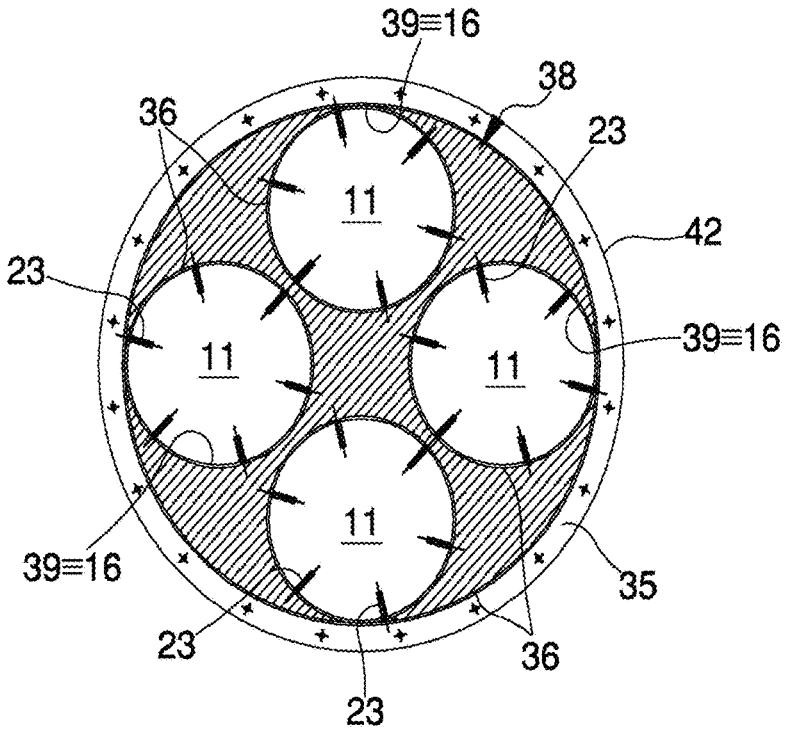

As shown in FIG. 12, the lateral face 34 of the inlet manifold 42 communicating with the loading portion 8 comprises a closing plate 38 provided only with the plurality of first openings 39 for the passage of the white slag S, corresponding to the number of treatment channels 11 and defining the supply ports 16.

The opposite lateral face 34, on the other hand, is similar to the cooling module 37.

In the outlet manifold 47, on the other hand, both lateral faces 34 are similar to those of the cooling module 37, shown in FIG. 10.

In more detail, in the lateral face 34 communicating with the sorting module 41, the first openings 39 allow the transfer of the recovery powder R and of the waste product inside the sorting modules 41, while the third openings 43 are connectable to respective rotating discharge ducts to allow the discharge of the coolant F.

The operation of the plant 1 is as follows.

First, the supply is provided of the white slag S resulting from the steelmaking processes as well as the loading of the white slag S inside at least one treatment and recovery plant 1.

Specifically, loading occurs inside the loading portion 8.

Loading can be done by means known to the technician skilled in the art such as, e.g., an auger, a conveyor belt, an extractor, or other similar systems, which take the material, e.g., from a collection hopper, where the slag S still hot is initially stored.

The white slag S is then made to move forward along at least one direction of treatment D so as to generate at least one stream of white slag S and controlled cooling of the stream of white slag S so as to obtain a recovery powder R.

According to the invention, the loading comprises a stage of splitting the white slag S along a plurality of mutually separate streams of white slag S.

Cooling is carried out on each of the streams of white slag S using a heat exchange system of the indirect type.

The movement and cooling stages are carried out inside the cooling portion 10 thanks to the presence of the plurality of treatment channels 11.

In particular, as described above, the splitting into multiple streams of white slag S occurs due to the rotation of the work chamber 3 during which the white slag S cyclically flows into one of the treatment channels 11.

During the transit of the white slag S inside the treatment channels 11, the coolant F transiting inside the return channel 22 arranged externally to the treatment channels themselves allows for a controlled cooling of the slag leading to the formation of the recovery powder R.

More particularly, as anticipated above, the coolant F is conveyed to the inlet manifold 42 by means of the delivery channel 21, which is centrally arranged inside the work chamber 3, and through the manifold itself it is conveyed along the return channel 22.

Subsequently, and continuously, sorting and picking of the recovery powder R from the plant 1 are carried out.

This stage takes place inside the sorting and separation portion 13 and by means of the collection means 26, the recovery powder R is collected and conveyed to any and further treatment and recovery stations.

It has in practice been ascertained that the described invention achieves the intended objects, and in particular the fact is emphasized that the plant for the treatment and recovery of white slag resulting from steelmaking processes according to the present invention allows optimizing the cooling process of the white slag, thus minimizing the plant dimensions.

In fact, the presence of a plurality of treatment channels allows splitting the white slag into several separate streams leading to an increase in the exchange surface between the white slag and the coolant.

The coolant supply system allows optimizing the compromise between energy efficiency and constructive simplicity.

In addition, the presence of a plurality of treatment channels allows the efficient and easy treatment of even large quantities of white slag.

Finally, the particular solution of having modular elements that can be assembled together allows the plant according to the invention to adapt easily to the production needs of the plant in which it is installed, while keeping its dimensions small.

The invention claimed is:

1. A plant for treatment and recovery of white slag resulting from steelmaking processes, the plant comprising:

at least one frame positionable resting on a supporting surface;

at least one work chamber supported by said frame, movable in rotation around an axis and configured to receive and treat the white slag resulting from steelmaking processes by means of a withering process, wherein said white slag is moved forward along at least one direction of treatment, said work chamber including:

a loading portion provided with at least one inlet port through which said white slag is loaded;

a cooling portion arranged downstream of said loading portion with respect to said direction of treatment and including:

at least one treatment channel of said white slag; and cooling means including at least one coolant adapted to operate in conjunction with said treatment channel to cool said white slag contained therein so as to obtain at least one recovery powder;

at least one sorting and separation portion of said recovery powder arranged downstream of said cooling portion with respect to said direction of treatment; wherein said cooling portion includes a plurality of treatment channels which are separate from each other and communicating with said loading portion, each of which is adapted to receive a part of said white slag as a result of the rotation of said work chamber, to cool and to convey said white slag towards said sorting and separation portion, said cooling means are arranged to enfold at least partly each of said treatment channels and include at least one delivery channel which extends at least through said cooling portion to send the coolant towards said loading portion counter-currently with respect to said direction of treatment, at least one return channel which extends through at least said cooling portion and is arranged to surround said delivery channel to send the coolant towards the sorting and separation portion parallel to said direction of treatment, equi-currently to said direction of treatment, wherein at least one stretch of said return channel is positioned between said treatment channels and said delivery channel, wherein said cooling means include at least one internally hollow cooling liner and said delivery channel and said return channel are arranged inside said cooling liner, where said return channel is positioned between said cooling liner and said delivery channel, said treatment channels being inserted inside said return channel, at least one inlet manifold arranged at a point where said loading portion is located and positioned between said loading portion and said cooling portion, wherein said inlet manifold is adapted to transfer the coolant from said delivery channel to said return channel, wherein said inlet manifold includes at least one transfer chamber of the coolant communicating with said delivery channel and with said return channel and said treatment channels pass through said transfer chamber, wherein said loading portion is arranged opposite said cooling portion with respect to said inlet manifold and defines at least one interspace communicating with said transfer chamber, and wherein said interspace includes at least one inlet gap of the coolant communicating with said transfer chamber and at least one outlet gap of the coolant communicating with said return channel and where said work chamber, including said loading portion, is movable in rotation around said axis, and said cooling means and said treatment channels rotate integrally with each other around said axis, the plant further comprising: at least one coolant supply duct communicating with said delivery channel and at least one coolant discharge duct communicating with said return channel, where said coolant supply duct and said coolant discharge duct are arranged downstream of said sorting and separation portion.

2. The plant according to claim 1, further comprising: movement means associated with said work chamber and operable to move the work chamber in rotation around said axis.

3. The plant according to claim 1, further comprising: adjustment means for adjusting an inclination of said axis.

4. The plant according to claim 3, further comprising at least one control and command unit operatively connected to at least one of either said movement means or said adjustment means and further comprising sensor means adapted to detect the temperature of the recovery powder and operatively connected to said control and command unit, the latter being configured to adjust at least one of either said movement means or said adjustment means according to the temperature detected by said sensor means.

5. The plant according to claim 4, wherein said control and command unit is configured to increase a rotational speed of said work chamber by means of said movement means and/or to increase the inclination of said work chamber by means of said adjustment means when the temperature detected by said sensor means exceeds a preset reference value.

6. The plant according to claim 1, wherein said treatment channels are arranged in a radial pattern with respect to said axis, each of said treatment channels includes a supply port communicating with said loading portion.

7. The plant according to claim 1, wherein each of said treatment channels includes a plurality of mixing elements which extend along said direction of treatment which are adapted to mix said white slag and to convey the white slag towards said sorting and separation portion.

8. The plant according to claim 1, wherein said work chamber is inclined with respect to an horizontal plane, said loading portion being positioned at a higher level than said sorting and separation portion.

9. The plant according to claim 1, wherein said loading portion has a substantially truncated-cone shape, diverging away from said inlet port.

10. The plant according to claim 1, wherein said loading portion includes a plurality of conveying elements adapted to direct said white slag towards said treatment channels.

11. The plant according to claim 1, wherein said sorting and separation portion includes a plurality of holes, each provided with at least one predefined size, adapted to allow an outflow of said recovery powder.

12. The plant according to claim 1, further comprising: collection means of said recovery powder arranged below said sorting and separation portion, said recovery powder falling by gravity from said sorting and separation portion to said collection means.

13. The plant according to claim 1, further comprising: at least one unloading portion arranged downstream of said sorting and separation portion with respect to said direction of treatment and adapted to allow the unloading of a waste product resulting from said withering process.

14. The plant according to claim 1, further comprising: a plurality of modular elements that can be assembled together to define at least said cooling portion.

15. The plant according to claim 14, further comprising: connecting means of said modular elements adapted to connect and keep the modular elements themselves joined together.

16. The plant according to claim 15, further comprising: sealing means positioned between said modular elements and adapted to operate in conjunction with said connecting means to hermetically connect said modular elements.

* * * * *